US011509981B2

(12) United States Patent
Christoph et al.

(10) Patent No.: US 11,509,981 B2
(45) Date of Patent: Nov. 22, 2022

(54) LOUDSPEAKER ARRANGEMENT

(71) Applicant: Harman Becker Automotive Systems GmbH, Karlsbad (DE)

(72) Inventors: Markus E Christoph, Straubing (DE); Paul Zukowski, Bogen-Furth (DE); Florin Negrut, Southfield, MI (US); Tingli Cai, Ann Arbor, MI (US); Andreas Frank, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/590,615

(22) Filed: Oct. 2, 2019

(65) Prior Publication Data

US 2020/0128312 A1 Apr. 23, 2020

Related U.S. Application Data

(60) Provisional application No. 62/746,817, filed on Oct. 17, 2018.

(51) Int. Cl.

| | |
|---|---|
| ***H04R 1/02*** | (2006.01) |
| ***H04R 1/08*** | (2006.01) |
| ***H04R 1/40*** | (2006.01) |
| ***H04R 3/12*** | (2006.01) |

(52) U.S. Cl.

CPC ..... *H04R 1/025* (2013.01); *H04R 1/08* (2013.01); *H04R 1/403* (2013.01); *H04R 3/12* (2013.01)

(58) Field of Classification Search

CPC ..... H04R 5/02; H04R 5/023; H04R 2499/13; H04R 2499/15; H04R 2201/023; H04R 3/12; H04R 1/02; H04R 1/08; H04R 1/025; H04R 1/345; H04R 1/26; H04R 1/2865; H04R 1/403; B60R 11/0217; H04B 1/082; H03G 3/32; A41D 1/005; H04S 1/002; H04S 3/00; H04S 7/301; H04S 7/302; H04N 5/642

USPC ..... 381/86, 333, 388, 389, 301–305

See application file for complete search history.

(56) References Cited

U.S. PATENT DOCUMENTS

| | | | | |
|---|---|---|---|---|
| 4,042,781 A | | 8/1977 | Wiseman | |
| 5,133,017 A | * | 7/1992 | Cain | B60N 2/879 381/71.6 |
| 6,744,898 B1 | | 6/2004 | Hirano | |
| 8,655,008 B2 | * | 2/2014 | Jagne | H04R 1/1091 381/388 |

(Continued)

FOREIGN PATENT DOCUMENTS

| | | | | |
|---|---|---|---|---|
| CN | 108471576 A | * | 8/2018 | H04R 5/02 |
| JP | H03 85096 A | | 4/1991 | |

(Continued)

*Primary Examiner* — Ahmad F. Matar
*Assistant Examiner* — Sabrina Diaz
(74) *Attorney, Agent, or Firm* — Angela M. Brunetti

(57) ABSTRACT

An example loudspeaker arrangement includes a seat configured to support a listener sitting in the seat so that a head of the listener is in a listening position; and a loudspeaker array secured to the seat and disposed in a position in front of a backrest of the seat and to the side of the head when the head is in the listening position. The loudspeaker array includes at least one loudspeaker and has a main broadcasting axis representative of a main broadcasting direction, the main broadcasting direction of the loudspeaker array pointing to the head.

26 Claims, 4 Drawing Sheets

(56) References Cited

U.S. PATENT DOCUMENTS

| | | | | |
|---|---|---|---|---|
| 10,477,303 | B1 * | 11/2019 | Kapolnek | H04R 1/403 |
| 2003/0142842 | A1 * | 7/2003 | Arai | A47C 7/72 381/300 |
| 2006/0262935 | A1 | 11/2006 | Goose et al. | |
| 2010/0041443 | A1 * | 2/2010 | Yokota | H04M 9/082 455/569.2 |
| 2015/0016651 | A1 | 1/2015 | Domash | |
| 2016/0100250 | A1 * | 4/2016 | Baskin | B60N 2/879 297/217.4 |
| 2017/0055078 | A1 | 2/2017 | Christoph | |
| 2017/0088266 | A1 | 3/2017 | Tracy | |
| 2018/0007466 | A1 * | 1/2018 | Hess | H04R 1/26 |

FOREIGN PATENT DOCUMENTS

| | | | |
|---|---|---|---|
| JP | H04 116450 | U | 10/1992 |
| JP | 2002191469 | A | 7/2002 |

* cited by examiner

FIG. 3
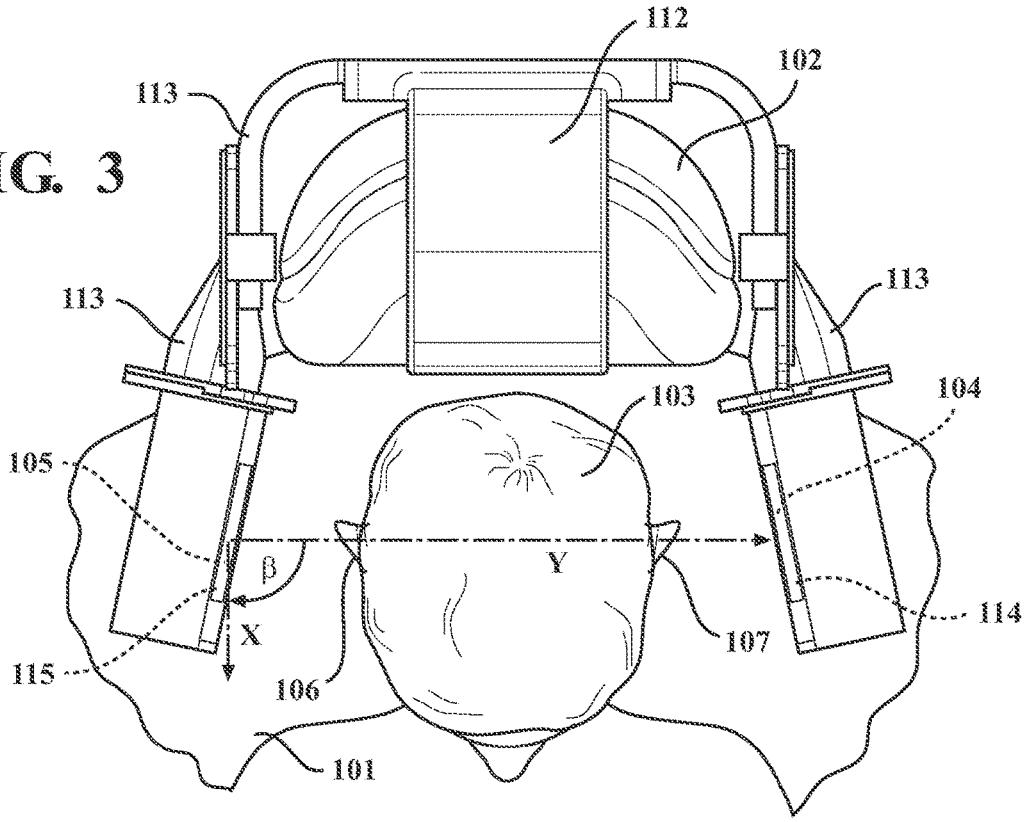
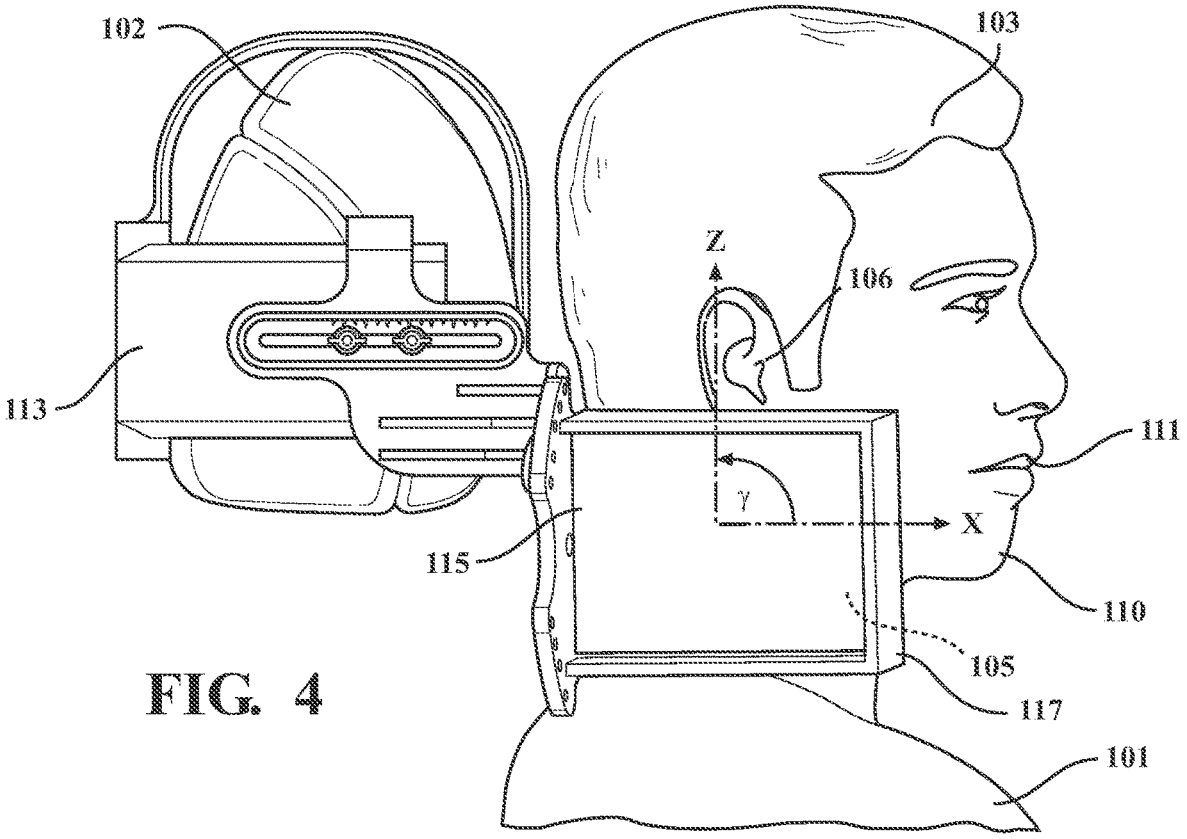
FIG. 4

LOUDSPEAKER ARRANGEMENT

CROSS-REFERENCE

This application claims the benefit of U.S. Provisional Application Ser. No. 62/746,817, filed Oct. 17, 2018, the disclosure of which is incorporated in its entirety by reference.

BACKGROUND

1. Technical Field

The disclosure relates to a loudspeaker arrangement.

2. Related Art

Individual sound zone (ISZ) systems, for example, allow to generate in any given space virtual sources or reciprocally isolated acoustic zones, in this context also referred to as "individual sound zones" (ISZ) or just sound zones. Creating individual sound zones has attracted greater attention not only due to the possibility of providing different acoustic sources in diverse areas, but especially due to the prospect of conducting speakerphone conversations in an acoustically isolated zone. ISZ systems produce an acoustic wave field which generates, at specific locations, acoustically illuminated (enhanced) zones, referred to as bright zones, and in other areas, acoustically darkened (suppressed) zones, referred to as dark zones. The greater the acoustic contrast between the bright and dark zones, the more effective the cross talk cancellation (CTC) between the particular zones will be and the better the ISZ system will perform.

Common ISZ systems, when, for example, installed in vehicles, utilize loudspeakers that are integrated in headrests of seats. The loudspeakers are thus disposed at the rear of a listener's head when the listener sits in the seat, which means in most cases at the rear ends of the corresponding sound zones. This leads to an undesirable acoustical performance in the bright zone since sound is inevitably perceived as coming from the rear, which causes an unnatural sound impression for the listener. Furthermore, CTC performance may be aggravating due to massive scattering of sound radiated by the loudspeakers in the headrest as sound is diffracted at the listener's head and shoulders. There is a desire to improve the performance of ISZ systems and systems that utilize similar loudspeaker arrangements.

SUMMARY

An example loudspeaker arrangement includes a seat configured to support a listener sitting in the seat so that a head of the listener is in a listening position; and a loudspeaker array secured to the seat and at least partly disposed in a position in front of a backrest of the seat and lateral of the head when the head is in the listening position. The loudspeaker array includes at least one loudspeaker and has a main broadcasting axis representative of a main broadcasting direction, the main broadcasting direction of the loudspeaker array pointing to the head.

Other arrangements, features and advantages will be, or will become, apparent to one with skill in the art upon examination of the following detailed description and appended figures. It is intended that all such additional arrangements, features and advantages be included within this description, be within the scope of the invention, and be protected by the following claims.

BRIEF DESCRIPTION OF THE DRAWINGS

The arrangement may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 3 is a top view of the situation depicted in FIGS. 1 and 2;

FIG. 4 is a side view of the situation depicted in FIGS. 1 to 3;

DETAILED DESCRIPTION

It has been found that by disposing the loudspeakers closer to a listener's ears, e.g. by placing them at a lateral position with regard to the listener's head, not only can a more natural sound perception be created in the bright zone, but also a better CTC performance can be achieved. Further improvement may be achieved by taking the acoustical characteristic of the room (e.g., defined by the size and position of hard reflective surfaces) into consideration. An accordingly designed loudspeaker arrangement improves the acoustics of the bright zone by acoustically spotlighting the ear positions and improves the CTC performance by reducing the reflective sound energy perceived within the dark zones and by using an improved alignment of the headrest speakers so that acoustical interferences caused by deflections from the listener's head and shoulders and from reflective surfaces of the room are significantly reduced. The improvement is achieved on the passive side of the system by adapting the loudspeaker positions to the (bright and dark) sound zones.

Figure 1:
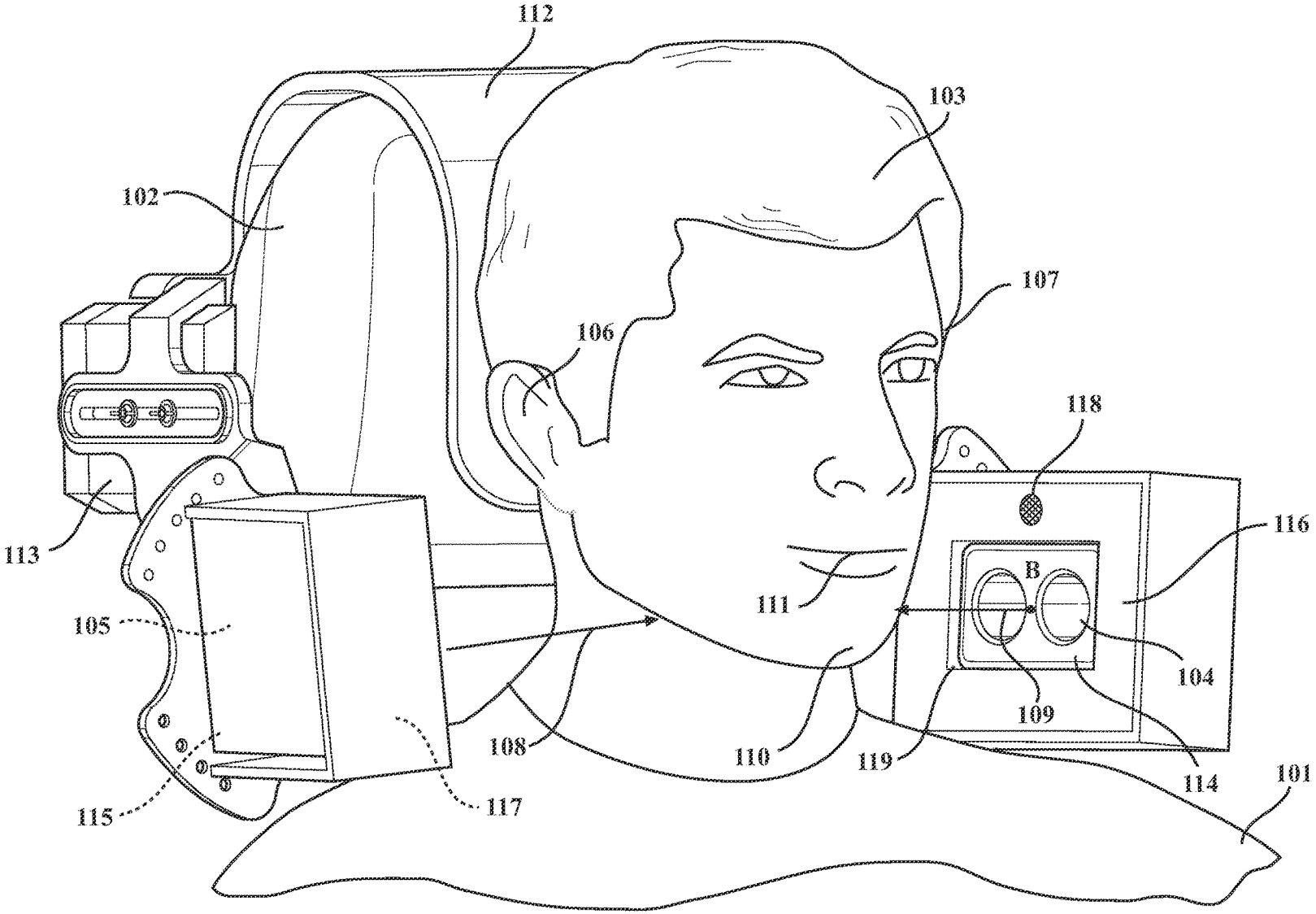
FIG. 1 is a perspective view of a listener sitting in a seat with an exemplary acoustic headrest.

FIG. 1 is a perspective view of a listener 101 from a front right direction of the listener 101 when the listener 101 sits in a seat (not shown) with a headrest 102, thereby defining a listening position of a listener's head 103. Two loudspeaker arrays 104 and 105 (array 105 is not visible in FIG. 1) are attached to the seat via the headrest 102 and are disposed in positions in front of a backrest (not shown) of the seat and on opposite sides of the head 103 when the head 103 is in the listening position. This means that the loudspeaker arrays 104 and 105 are disposed laterally to the head 103, i.e. adjacent to ears 106 and 107 of the head 103 (ear 107 is not visible in FIG. 1). The loudspeaker arrays 104 and 105 each have a main broadcasting axis (direction) 108, 109 that is representative of a respective main broadcasting direction. The main broadcasting directions of the two loudspeaker arrays 104 and 105 point to the head 103. In the example shown, the main broadcasting directions point particularly to a chin 110 or mouth 111 of the head 103.

The loudspeaker arrays 104 and 105 may be directly (not shown) or indirectly (shown) secured to the seat. In the example shown, an essentially u-shaped rigid sheet 112 made from metal, plastics or any other appropriate rigid material, which may totally or partly be coated with a foam layer or any other appropriate soft material for passenger safety and/or comfort reasons, is pulled over the headrest 102 from top down. A more or less u-shaped support structure 113 is secured to the sheet 112 on a rear side of the sheet 112, i.e., on the side turned away from the head 103, and is disposed to provide support for the loudspeaker arrays 104 and 105 in lateral positions relative to the head 103. Alternatively, the support structure may directly be secured to the headrest 102 or the seat (e.g., its backrest). In the example shown, the support structure 113 includes a multiplicity of (e.g., five) interconnected parts but may alternatively be designed integrally, i.e., in a single piece. In a further alternative, the single-piece or multi-piece support structure may be integrated in the backrest or headrest. Further, the support structure may manually or automatically, electrically, hydraulically, or mechanically be tiltable, shiftable or retractable to facilitate boarding of the listener. The loudspeaker arrays 104 and 105 may be integrated in respective (vented or not vented) housings 114 and 115 which may secure the loudspeaker arrays 104 and 105 to the support structure 113.

Figure 2:
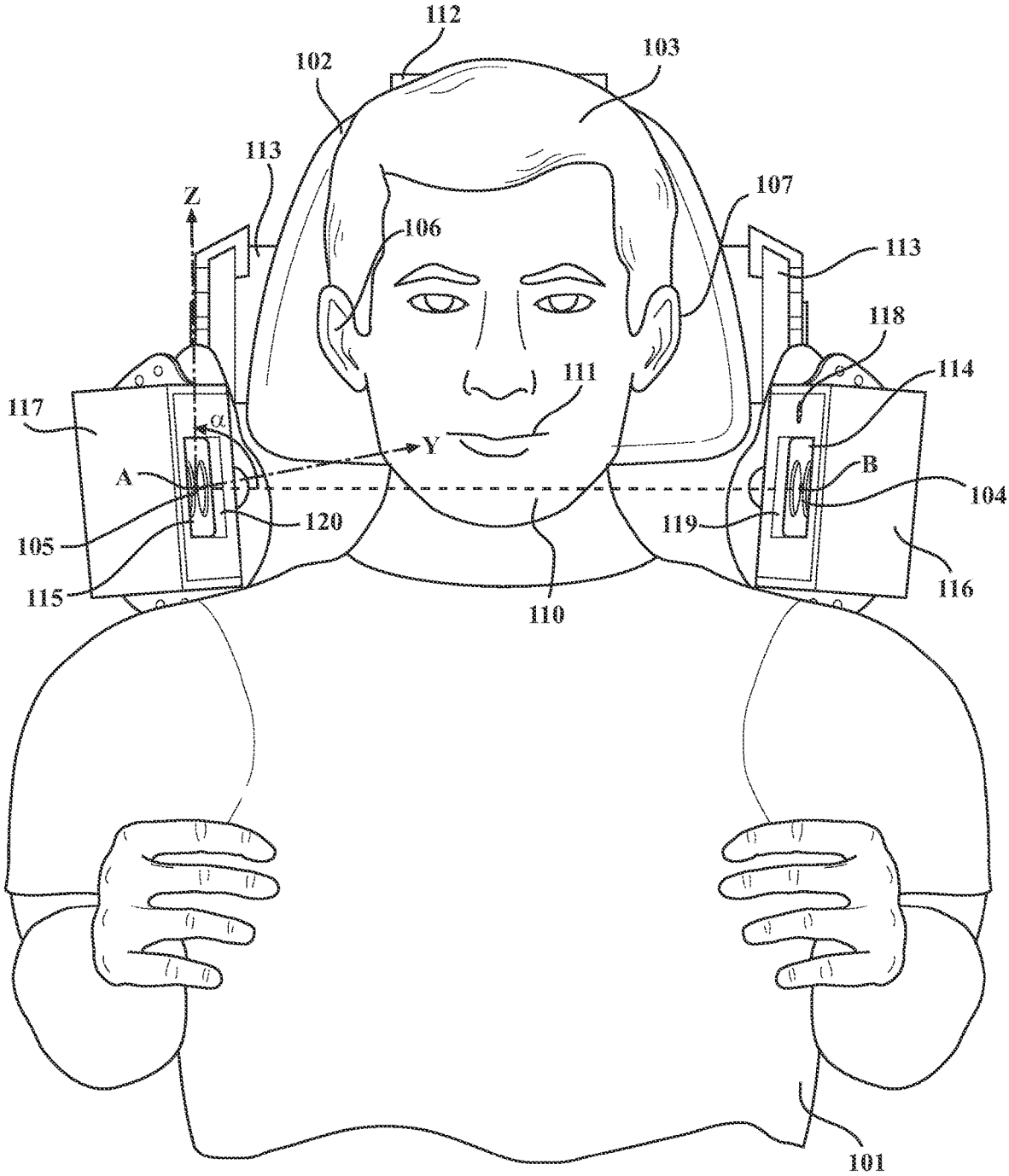
FIG. 2 is a front view of the situation depicted in FIG. 1.

FIG. 2 is a front view of the arrangement depicted in FIG. 1, in which a z-axis is indicated by a straight arrow Z intersecting (originating from) midpoint A of loudspeaker array 105 (additionally or alternatively 104) and extending in a vertical direction. A y-axis is indicated by a straight arrow Y originating from midpoint A of loudspeaker array 105 (104) and intersecting perpendicularly (extending perpendicularly away) from the loudspeaker array, and an angle $\alpha$ between z-axis and y-axis is indicated by a curved arrow. Further, midpoints of the loudspeaker arrays 104, 105 are depicted in FIG. 2 by points A and B. The midpoint A (as well as midpoint B) may correspond in terms of a level along the z-axis to the level of the listener's chin 110 and the size of the enclosures 114, 115 with integrated loudspeaker arrays 104, 105 may be dimensioned to allow the listener 101 an unobstructed panoramic view, without adversely affecting the acoustics in the bright zone and the CTC performance.

Further, loudspeaker arrays disposed at this level generate in operation less reflections at the listener's head than as would be the case at higher levels, e.g. at ear level, which results in a better CTC performance. In another example, the distance between point A and point B is chosen to be greater than the width of the headrest 102 and equal to or less than the width of the backrest of the seat. The distance may be, for example, 350 mm to allow for a free and safe movement of the listener 101. A corresponding tilt of the loudspeaker array 105 (104) represented by the angle $\alpha$ may be selected to be somewhere between 0° and 50°. The angle $\alpha$ is of some importance for the separation into bright zones and dark zones in general, and particularly in view of the material and shape utilized in building or cladding the room, e.g., its ceiling. For example, if a reflective hard surface is used in the ceiling such as glass, the angle of sound reflection could be such that sound is transferred from a bright zone to a dark zone via reflections occurring at an occupant's head and at the ceiling and depending on where further occupants are seated in this room. Hence the angle $\alpha$ may be selected such that reflections that are perceivable at the dark zones are minimized. If, for example, the ceiling is not reflective (e.g., no sunroof), the angle $\alpha$ may be chosen to be larger, as sound absorbing characteristics of the ceiling (e.g., sound absorbing material in the headliner) attenuates sound and, thus, reduces the reflective sound energy transferred to the dark zone, which enhances the CTC performance. For example, the angle $\alpha$ may be selected to be approximately 20°.

FIG. 3 is a top view of the arrangement depicted in FIGS. 1 and 2, in which an x-axis is indicated by a straight arrow X intersecting (originating from) midpoint A of loudspeaker array 105 (additionally or alternatively 104) and extending in a horizontal direction. The y-axis is again indicated by the straight arrow Y intersecting (originating from) midpoint A of loudspeaker array 105 (104) and extending away from the loudspeaker array 105 (104) under an angle $\beta$ (indicated by a curved arrow) with regard to the x-axis. The midpoints of the loudspeaker arrays 104, 105 are depicted in FIG. 3 by points A and B. The midpoints A and B may be disposed such that a virtual line between midpoints A and B intersects the listener's ears 106, 107 to allow for an optimum balance between bright zone performance and CTC, in contrast to loudspeaker arrays arranged behind the ears, i.e., closer to the headrest, which exhibit worse acoustics in the bright zone but a somewhat better CTC. With loudspeaker arrays disposed further away from the headrest in x-direction, the perceivable sweet spot area also moves to the front, resulting in better acoustics in the bright zone but in a somewhat worse CTC. The distance from headrest to the loudspeaker array's mid position may be, for example, approximately 130 mm.

A corresponding tilt of the loudspeaker array represented by angle $\beta$ may be somewhere between 0° and 30°. This angle is of some importance for the separation of the bright zones from the dark zones in that this tilt allows to reflect sound at the listener's head in a direction other than in that of occupant position directly next to it. This tilt angle also allows to enlarge the bright zone and is beneficial for the perceived performance even if the head moves towards the vicinity of the listening position. This tilt angle also allows to widen the area available to the listener's head. The angle $\beta$ may be, for example, approximately 15°.

FIG. 4 is a side view of the arrangement depicted in FIGS. 1 to 3, in which the x-axis and the z-axis as described above in connection with FIGS. 2 and 3 are depicted in connection with a tilt angle $\alpha$ between the x-axis and the z-axis. This tilt angle has no significant influence on zone separation and CTC due to the rotational symmetry of a directivity pattern (radiation characteristics) of the loudspeaker array 105 (104).

Figure 5:
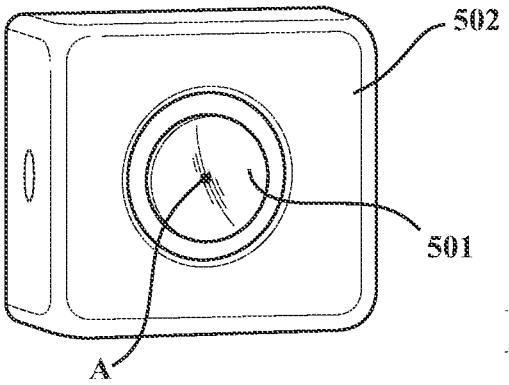
FIG. 5 is a schematic diagram illustrating a loudspeaker integrated in a housing and having a single loudspeaker.
Figure 6:
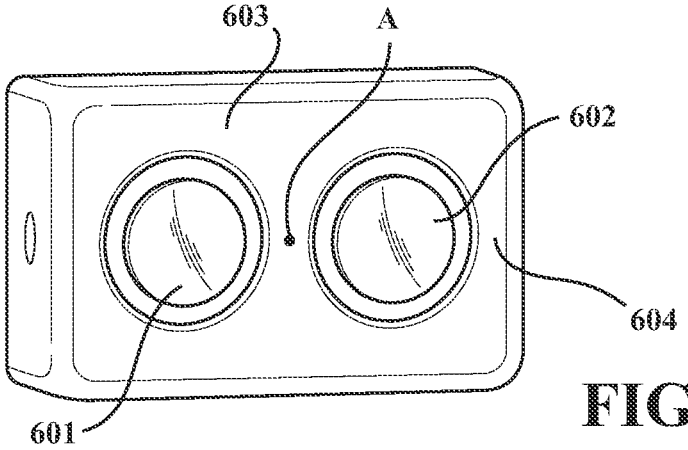
FIG. 6 is a schematic diagram illustrating a loudspeaker array integrated in a housing and having two identical loudspeakers.
Figure 7:
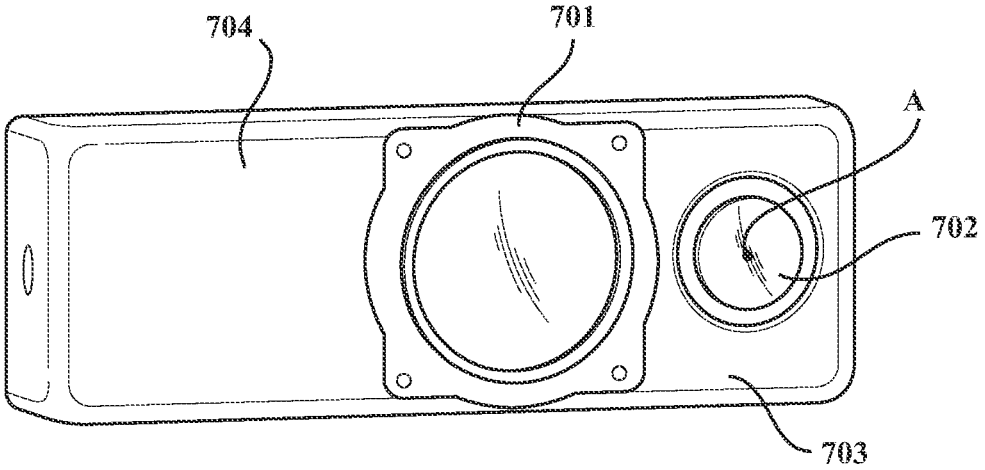
FIG. 7 is a schematic diagram illustrating a two-way loudspeaker array integrated in a housing.

Referring to FIGS. 5 to 7, the loudspeaker arrays 104 and 105 may each comprise one or more loudspeakers. As shown in FIG. 5, in a minimum configuration one loudspeaker 501 per array (and housing 502) is utilized. This minimum configuration may be employed for cost and space reasons. In this configuration, the mid point of the loudspeakers surface forms the array's midpoint A (B), which may be placed, in position corresponding to the position of the listener's ear(s) along the x-axis. The performance of the whole arrangement can be further improved by using two or more speakers. However, upon considering the extent of improvement in relation to the number of loudspeakers, it has been revealed that two loudspeakers per array provide the best cost to performance ratio. If two loudspeakers 601 and 602 per array 603 (and housing 604) are used as depicted in FIG. 6, the placement of the loudspeaker's mid point A (B), which is exactly between the loudspeakers 601 and 602, may match the position of the listener's ear(s) along the x-axis. Alternatively, the mid point may be the mid of either loudspeaker 601 or 602. In a further example, the two (or more) loudspeakers per array are placed as close as possible to each other. Further, each speaker may optionally operate with its own sealed acoustic volume so that they do not interfere with each other to the largest possible extent. Employing two or more loudspeakers per array also allows for the use of beamforming algorithms to further improve the acoustics in the bright zone as well as the CTC performance.

In a further example illustrated in FIG. 7, two loudspeakers 701 and 702 with different spectral characteristics form an array 703 which is integrated in a housing 704. In order to improve the low frequency separation of the different sound zones, one of the loudspeakers, e.g., loudspeaker 701 is a lower-frequency loudspeaker such as a woofer or a suitable midrange loudspeaker. The other loudspeaker 702 may be a higher-frequency loudspeaker such as a suitable midrange loudspeaker or tweeter.

In a further example, the midpoint of loudspeaker 702 may form the mid point A (B) of the array 703. In a still further example, the mid point A (B) of the array 703 may be positioned close to the position of the listener's ear(s) along the x-axis while lower-frequency loudspeaker 701 is placed in a position along the x-axis behind the position of the listener's ear(s), i.e., closer to the headrest than the position of the loudspeaker 702. In a further example (not shown), the lower-frequency loudspeaker may also be placed directly in the headrest or backrest but may point to the ear positions of the listener. The headrest and to a greater degree the backrest allow for installing larger loudspeakers such as higher-power lower-frequency loudspeakers which may be utilized, for example, in some applications, such as individual sound zone systems and road noise control systems.

In a still further example, the lower-frequency loudspeaker 701 and the higher-frequency loudspeaker 702 are arranged as close as possible to each other. However, due to design, safety or spacing reasons it could be desired to move the lower-frequency loudspeaker closer to the headrest, into the headrest or into the backrest. This change of loudspeaker position may lead to a worsening of CTC performance for low frequencies, but this can be overcome by using a more powerful loudspeaker and thus offers some improvement in the low frequency performance over common arrangements due to the close proximity of the lower-frequency loudspeaker to the individual zones, which enables a significant improvement of the CTC performance.

Referring again to the example shown in FIG. 1, the support structure 113 is here, as already outlined, a multi-piece structure and has two end pieces 116 and 117 that serve as a carrier for the housings 114 and 115 with integrated loudspeaker arrays 104 and 105 by encompassing the housings 114, 115 within all sides of the housings 114, 115 whereas the front side is designed such that a desired break-off edge emerges which not only improves the passenger safety but also has been found to provide a better acoustic performance at high frequencies, perceivable in the bright zone. It has also been found that a hard break-off edge (without soft moldings) with a depth of 5-10 mm delivers good acoustic results with no negative effects to the CTC. A wave guide 119 (120) is arranged between housing 114 (115) and end piece 116 (117). The housing 114 (115) may be shifted towards the interior of the end piece 116 (117). The wave guide 119 (120) may include a hard break-off edge to enhance higher frequency performance, e.g., up to 20 kHz.

Further referring to FIG. 1, by integrating one or more microphones 118 in the arrays, housings and/or carriers in individual sound zone systems and systems with similar requirements such as hands-free telephony systems, in-car-communication systems, automatic noise control systems etc. can be improved as well, since the position of the microphones is in close proximity to the potential position of the mouth or ear of the listener which, in the example shown in FIG. 1, is above the housing 114, 115 in the (upper half and) the middle between front and rear part of carrier 116, 117. Dependent on the position of the carrier along the x-axis, the microphone(s) may alternatively be disposed in the front or rear part of the carrier. Alternatively, the microphone(s) may be integrated in the housing or the loudspeaker array instead of the carrier. If one or more microphones are disposed at each side of the head, this allows to avoid deviations in the recorded speech level when the listener turns her/his head. Beamforming may be applied to further improve the performance, thereby increasing the effective signal-to-noise ratio (SNR). However, since the microphone position(s) is/are, in most situations, already well within a reverberation radius, in most cases a single microphone per side may perform sufficiently. In some examples, the microphones are directed, like the loudspeakers, to the listener's head, e.g., to the mouth of the passenger. In this way shading effects of the housing and/or carrier help to suppress sound from sources other than the passenger's mouth.

The description of embodiments has been presented for purposes of illustration and description. Suitable modifications and variations to the embodiments may be performed in light of the above description or may be acquired from practicing the methods. The described arrangements are exemplary in nature, and may include additional elements and/or omit elements.

As used in this application, an element recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and arrangements have been disclosed in the context of certain embodiments and examples, it will be understood that these techniques and systems may be extended beyond the specifically disclosed embodiments to other embodiments and/or uses and obvious modifications thereof.

The invention claimed is:

1. A loudspeaker arrangement comprising:

a seat configured to support a listener sitting in the seat so that a head of the listener is in a listening position; and a loudspeaker array secured to the seat and disposed at least partly in a position in front of a backrest of the seat, below an ear of the listener, and to one side of the head when the head is in the listening position, the loudspeaker array comprising at least one loudspeaker having a midpoint below the ear of the listener at a level of a chin or mouth of the head and having a main broadcasting axis representative of a main broadcasting direction, the main broadcasting direction of the loudspeaker array pointing to a chin or mouth of the head defined by x, y, and z axes;

a first tilt angle of the main broadcasting direction minimizes reflections in a dark zone, the first tilt angle is an angle between the y and z axes within a range of 0° to 50°; and a second tilt angle of the main broadcasting direction reflects sound at the head in a direction other than that of an occupant in a directly adjacent position to the listener, the second tilt angle is an angle between the x and y axes within a range of 0° and 30°.

2. The arrangement of claim 1, further comprising a further loudspeaker array secured to the seat and at least partly disposed in a position in front of the backrest of the seat, below an ear of the listener, and to one side of the head when the head is in the listening position so that the loudspeaker array and the further loudspeaker array are disposed on opposite sides of the head, the further loudspeaker array comprising at least one loudspeaker having a midpoint below the ear of the listener at a level of the chin or mouth of the head and having a main broadcasting axis representative of a main broadcasting direction, the main broadcasting direction of the further loudspeaker array pointing to the chin or mouth of the head.

3. The arrangement of claim 2, further comprising a headrest attached to the seat, wherein at least one of the loudspeaker array and the further loudspeaker array is secured to the seat via, the headrest.

4. The arrangement of claim 2, further comprising a support structure configured to secure at least one of the loudspeaker array and the further loudspeaker array to the seat.

5. The arrangement of claim 4, wherein the support structure is tiltable, shiftable or retractable in a headrest or the backrest of the seat.

6. The arrangement of claim 2, wherein at least one of the loudspeaker array and the further loudspeaker array is integrated in a housing.

7. The arrangement of claim 6, wherein the housing has at least two separate acoustic volumes.

8. The arrangement of claim 2, wherein the midpoint is along the x-axis in a position that corresponds to the ear of the listener, or behind the ear of the listener, or in front of the ear of the listener.

9. The arrangement of claim 2, comprising the loudspeaker array and the further loudspeaker array having respective midpoints, wherein a distance between the respective midpoints of the loudspeaker array and the further loudspeaker array is more than a width of a headrest and equal to or less than a width of the backrest of the seat.

10. The arrangement of claim 1, wherein the arrangement has an upper level that is configured to allow for an unobstructed panoramic view of the listener.

11. The arrangement of claim 2, wherein at least one of the loudspeaker array and the further loudspeaker array comprises two identical loudspeakers.

12. The arrangement of claim 11, wherein the midpoint of at least one of the loudspeaker array with identical loudspeakers and the further loudspeaker array with identical loudspeakers is defined by half a distance between the two identical loudspeakers or by a mid of one of the two identical loudspeakers.

13. The arrangement of claim 12, wherein at least one of the loudspeaker array and the further loudspeaker array further comprises two loudspeakers with differing spectral characteristics.

14. The arrangement of claim 13, wherein one of the two loudspeakers with differing spectral characteristics has lower-frequency characteristics and another of the two loudspeakers has higher-frequency characteristics.

15. The arrangement of claim 14, wherein the midpoint of at least one of the loudspeaker array with loudspeakers with differing spectral characteristics is defined by a position that corresponds with a midpoint of the speaker with the higher-frequency characteristics and the midpoint of the further loudspeaker array with loudspeakers with differing spectral characteristics is defined by a position that corresponds with a midpoint of the speaker with the higher-frequency characteristics.

16. The arrangement of claim 15, wherein the midpoint of at least one of the loudspeaker array with loudspeakers with differing spectral characteristics and the further loudspeaker array with loudspeakers with differing spectral characteristics is disposed at a position that corresponds with the ear of the listener or a position between the ear of the listener and a headrest or the backrest of the seat.

17. The arrangement of claim 2, further comprising at least one microphone disposed in at least one of the loudspeaker array and the further loudspeaker array.

18. The arrangement of claim 17, further comprising the at least one microphone disposed adjacent the ear of the listener or the mouth of the listener.

19. The arrangement of claim 6, further comprising at least one microphone disposed in an upper half of the housing.

20. A loudspeaker arrangement in a seat having a headrest configured to support a listener in the seat so that a head of the listener is in a listening position, the arrangement comprising:

a support structure that is tiltable, shiftable or retractable in the headrest;

a first loudspeaker array secured to the support structure in a first housing on a first carrier, the first loudspeaker array is disposed partly in a position in front of a backrest of the seat, below an ear of the listener, and to one side of the head when the head is in the listening position;

at least one loudspeaker in the first loudspeaker array having a main broadcasting axis representative of a main broadcasting direction, the main broadcasting direction of the loudspeaker array pointing to a mouth or chin of the head and defined by x, y, and z axes;

a second loudspeaker array secured to the support structure in a second housing on a second carrier, the second loudspeaker array is at least partly disposed in a position in front of the backrest of the seat, below an ear of the listener, and to one side of the head when the head is in the listening position so that the first loudspeaker array and the second loudspeaker array are disposed on opposite sides of the head;

at least one loudspeaker in the second loudspeaker array having a main broadcasting axis representative of a main broadcasting direction, the main broadcasting direction of the second loudspeaker array pointing to the mouth or chin of the head;

a midpoint has a level along the z-axis that corresponds to a level of the chin or mouth of the head along the z-axis; the z-axis intersecting a midpoint of at least one of the first loudspeaker array and the second loudspeaker array and extending in a vertical direction;

a first tilt angle of the main broadcasting direction minimizes reflections in a dark zone, the first tilt angle is an angle between the y and z axes within a range of 0° to 50°; and a second tilt angle of the main broadcasting direction reflects sound at the head in a direction other than that of an occupant in a directly adjacent position to the listener, the second tilt angle is an angle between the x and y axes within a range of 0° and 30°; and at least one of the first loudspeaker array, the first housing, and the first carrier is arranged relative to another of the first loudspeaker array, the first housing, and the first carrier to define a break-off edge thereby creating a waveguide, and at least one of the second loudspeaker array, the second housing, and the second carrier is arranged relative to another of the second loudspeaker array, the second housing and the second carrier to define a break-off edge thereby creating a waveguide.

21. The arrangement of claim 20, further comprising a first acoustic volume associated with the first housing and a second acoustic volume associated with the second housing.

22. The arrangement of claim 20, further comprising a distance between the midpoint of the first loudspeaker array and the midpoint of the second loudspeaker array is more than a width of the headrest and equal to or less than a width of the backrest of the seat.

23. The arrangement of claim 20, further comprising an upper level that is configured to allow for an unobstructed panoramic view of the listener.

24. The arrangement of claim 20, further comprising at least one microphone disposed in at least one of the first loudspeaker array, the second loudspeaker array, the first housing, the second housing, the first carrier and the second carrier.

25. The arrangement of claim 24 wherein the at least one microphone is disposed in at least one of an upper half of the first housing, the second housing, the first carrier and the second carrier.

26. The arrangement of claim 24 wherein the at least one microphone is disposed adjacent to the mouth of the listener or the ear of the listener.

* * * * *